United States Patent [19]

Ludwig et al.

[11] Patent Number: 4,638,889

[45] Date of Patent: Jan. 27, 1987

[54] ELEVATOR SYSTEM

[75] Inventors: Richard H. Ludwig, West Caldwell, N.J.; Joanne E. Mikhail, Herndon, Va.

[73] Assignee: Westinghouse Electric Corp., Pittsburgh, Pa.

[21] Appl. No.: 742,835

[22] Filed: Jun. 10, 1985

[51] Int. Cl.[4] ..... B66B 1/22

[52] U.S. Cl. ..... 187/29 R

[58] Field of Search ..... 187/29

[56] References Cited

U.S. PATENT DOCUMENTS

| | | | |
|---|---|---|---|
| 4,037,688 | 7/1977 | Winkler | 187/29 |
| 4,046,227 | 9/1977 | Kirsch et al. | 187/29 |
| 4,082,164 | 4/1978 | Sackin et al. | 187/29 R |
| 4,448,286 | 5/1984 | Kuzunuki et al. | 187/29 R |

*Primary Examiner*—William M. Shoop, Jr.
*Assistant Examiner*—W. E. Duncanson, Jr.
*Attorney, Agent, or Firm*—D. R. Lackey

[57] ABSTRACT

An elevator system, and method of operating same, having a plurality of elevator cars for serving hall calls registered from the floors of a building. All of the up and down service directions from the floors are continuously assigned to the elevator cars, whether or not they have an active registered hall call associated therewith, with the assignments being made according to predetermined averages which uniformly spread the actual and prospective work loads among the elevator cars. The hall calls are timed. A timed-out call, i.e., a call registered for a predetermined period of time, is given preferential treatment, without significantly disturbing service to other registered hall calls, by assigning the floor and service direction associated with the timed-out call to an additional car which is not already assigned to a timed-out call. The additional car is selected on the basis of its having the lightest work load schedule of all of the elevator cars conditioned to serve the timed-out call.

8 Claims, 8 Drawing Figures

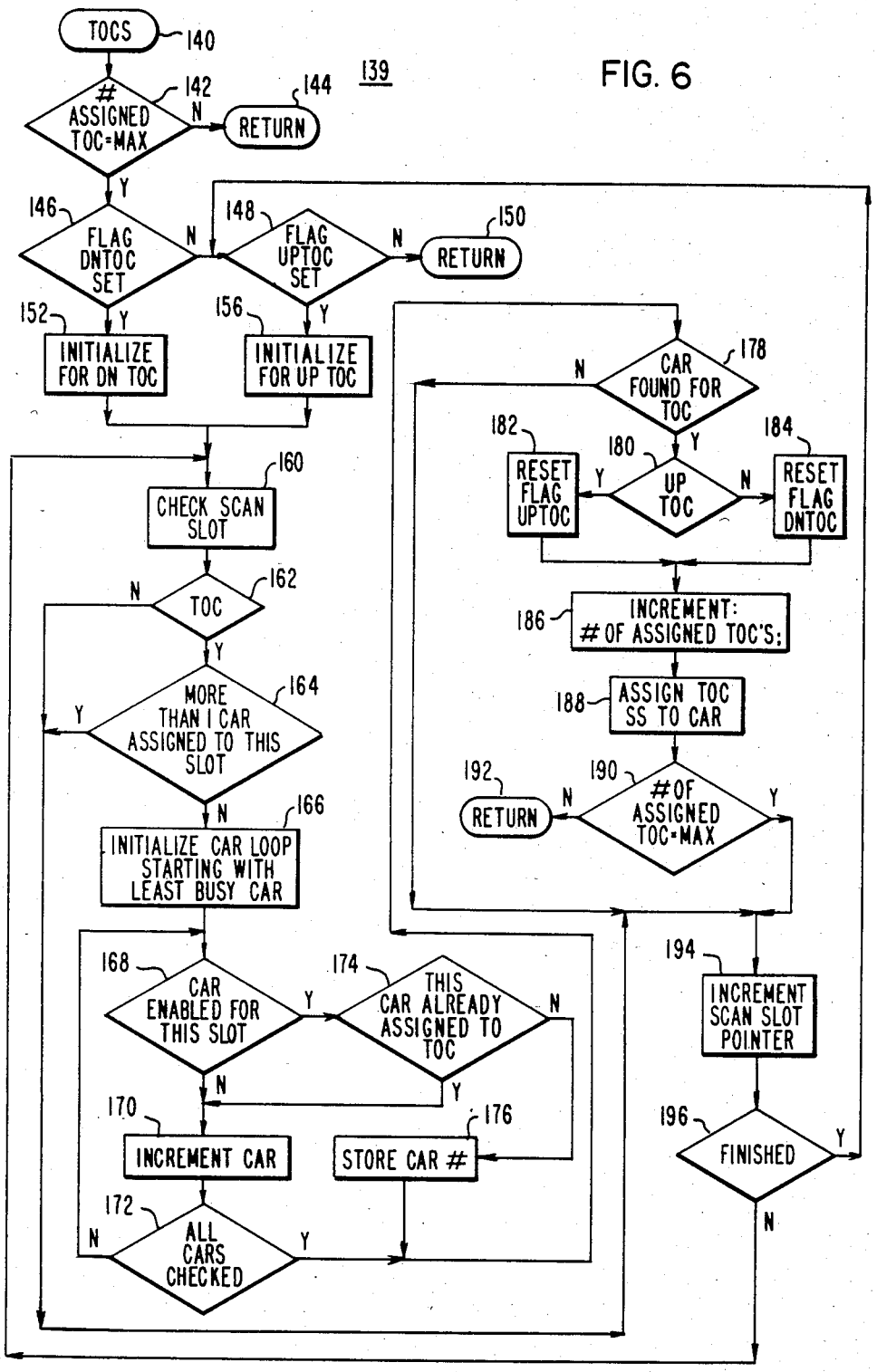
TOCS
140
139
FIG. 6
ASSIGNED TOC=MAX
142
N
144
RETURN
Y
146
FLAG DNTOC SET
N
148
FLAG UPTOC SET
N
150
RETURN
152
Y
INITIALIZE FOR DN TOC
156
Y
INITIALIZE FOR UP TOC
160
CHECK SCAN SLOT
162
TOC
N
Y
164
MORE THAN I CAR ASSIGNED TO THIS SLOT
Y
N
166
INITIALIZE CAR LOOP STARTING WITH LEAST BUSY CAR
168
CAR ENABLED FOR THIS SLOT
Y
174
THIS CAR ALREADY ASSIGNED TO TOC
N
N
Y
170
INCREMENT CAR
176
STORE CAR #
172
ALL CARS CHECKED
N
Y
178
CAR FOUND FOR TOC
N
Y
182
RESET FLAG UPTOC
Y
180
UP TOC
N
184
RESET FLAG DNTOC
186
INCREMENT: # OF ASSIGNED TOC'S:
188
ASSIGN TOC SS TO CAR
192
RETURN
N
190
OF ASSIGNED TOC=MAX
Y
194
INCREMENT SCAN SLOT POINTER
196
FINISHED
Y
N

ELEVATOR SYSTEM

BACKGROUND OF THE INVENTION

The invention relates in general to multiple car elevator systems, and methods of operating same, including strategy for providing preferential service to a long-wait call.

DESCRIPTION OF THE PRIOR ART

U.S. Pat. Nos. 4,037,688 and 4,046,227, which are assigned to the same assignee as the present application, set forth new and improved group supervisory control and strategy for operating a multiple car elevator system. Basically, the strategy assigns all of the service directions from all of the floors of a building, referred to as scan slots, to all in-service elevator cars according to dynamic averages calculated in response to the number of scan slots per in-service car and the number of hall calls per in-service car. The strategy continuously and uniformly spreads the actual and prospective work loads or schedules among the in-service cars. Theoretically, this strategy should provide the best overall elevator service to the building, making it unnecessary to include special strategies for serving long-wait hall calls. In other words, there should be no calls which have a waiting time greatly in excess of the average call waiting time for the system, such as may occur in prior art dispatching strategies due to strategy weaknesses which may occur during certain types of traffic conditions. The best conceived group operating strategy, however, cannot cope with unduly long door-open times, such as occasionally occur due to heavy passenger loading and unloading, and/or due to deliberate holding of the door in the open position to wait for prospective passengers. Unduly long door-open times thus adds to the time required to serve the hall calls which are assigned to the affected car, even when there is another elevator which could easily serve these hall calls.

Taking an elevator car out of service and expressing it to long-wait call, as is common in prior art time-out strategies, is not a good solution in the context of the overall strategy of the hereinbefore mentioned patents. Unlike many prior art strategies, the strategy of the hereinbefore mentioned patents does not have an "available" car. All elevator cars are assigned scanned slots. Thus, a car will immediately respond to a hall call associated with an assigned scan slot, without the need for the hall call after it is registered. An elevator car may be idle because it has no hall calls associated with its assigned scan slots, but it is not available within the prior art meaning of the word, as the car has assignments. Thus, taking an elevator car out of service and reassigning its assignments to the remaining elevator cars may deleteriously affect the service provided by the remaining in-service cars. The waiting times for serving their hall calls will undoubtedly increase, and during heavy elevator service it may create other timed-out calls, resulting in other elevator cars being taken out of service to provide priority service to timed-out calls, up to the maximum number allowable within the strategy. Thus, the simplicity and effectiveness of the averaging strategy may be destroyed by a strategy which takes elevator cars out of normal service.

SUMMARY OF THE INVENTION

Briefly, the present invention improves upon the averaging group supervisory strategy of the hereinbefore mentioned U.S. Patents, while operating within the constraints of the averaging concepts. The hall calls are timed, and if a call reaches a predetermined value, preferential treatment is provided to this floor by assigning the floor and service direction associated with the elevator car to an additional car. The assignment is made from the additional car without removing the assignment to the originally assigned car. The additionally assigned car is selected on the basis of its not having any other assigned timed-out calls, and also on the basis of having the lightest work load or schedule of all of the elevator cars suitably conditioned to serve the timed-out call. "Suitably conditioned" means that the elevator car is enabled for the floor of the timed-out call, and it has a travel and service direction consistent with the service direction of the timed-out call. The relative work schedules may be determined by any suitable criteria, such as by counting the car calls and hall calls already assigned to each car. When the additional assignment is made to a selected car, its other assignments are not changed. Also, when an assignment of a timed-out call is made to a selected car, the hall call count and scan slot count are each inflated by one, and these inflated counts are used in subsequent calculations of scan slot per car average and hall call per car average. Inflating these counts weights future scan slot assignments to elevator cars which are not assigned to a timed-out call.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 6 is a detailed flow chart of a timed-out call module which may be placed in bid or called when the program of FIG. 2 indicates that there is a timed-out call in the system;

DESCRIPTION OF THE PREFERRED EMBODIMENTS

Figure 1:
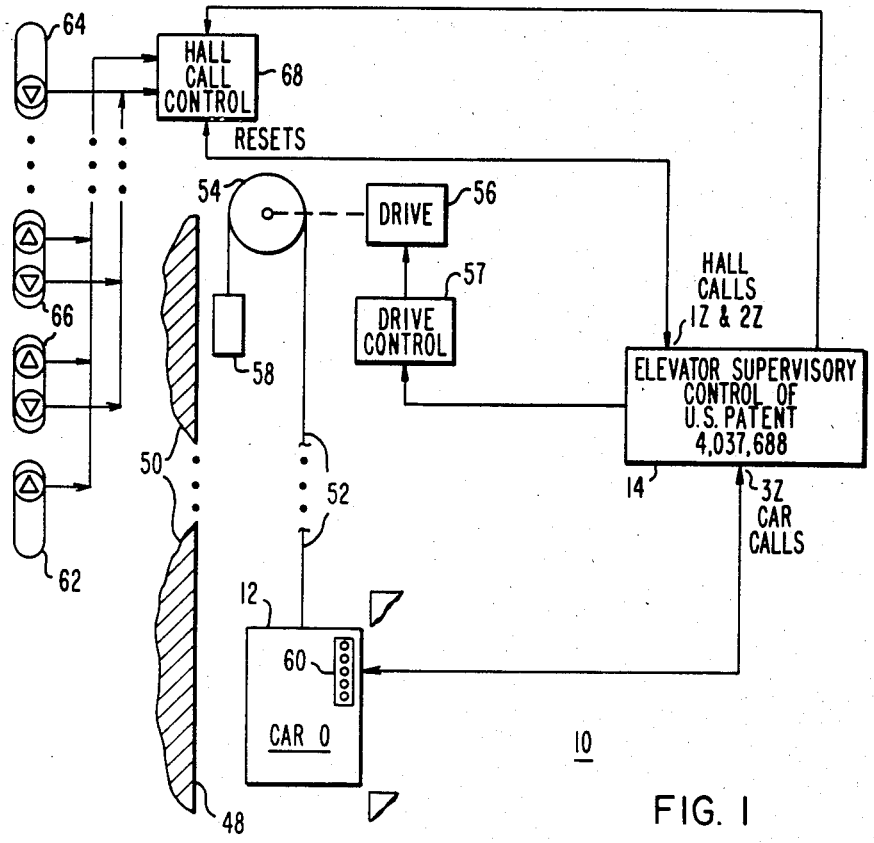
FIG. 1 is a partially schematic and partially block diagram of an elevator system, including supervisory system control which may utilize the teachings of the invention.

U.S. Pat. No. 4,037,688 describes a group supervisory strategy for elevator systems of the type which may be improved by the teachings of the invention. The elevator cars of such a system may utilize any suitable individual control. For purposes of example, the car controller disclosed in U.S. Pat. No. 3,750,850 may be used. U.S. Pat. No. 3,804,209 discloses modifications to the car controller of U.S. Pat. No. 3,750,850 to adapt it for control by a programmable system processor. In order to avoid unnecessary duplication and limit the complexity of the present application, these patents, which are assigned to the same assignee as the present application, are hereby incorporated into the present application by reference. Referring now to the drawings, and FIG. 1 in particular, there is shown an elevator system 10 which may utilize the teachings of the invention. Elevator system 10 includes a bank of elevator cars, with a single car 12 being illustrated in order to simplify the drawing, since the remaining cars would be similar. Elevator system 10 includes control 14 which includes each elevator car's car controller, as well the group supervisory control. FIG. 1 of the incorporated U.S. Pat. No. 4,037,688 illustrates the control functions included in control 14 in detail.

Elevator car 12 is mounted in a hoistway 48 for movement relative to a building 50 having a plurality of floors or landings, with only a few floors being illustrated in order to simplify the drawing. Elevator car 12 is supported by a plurality of wire ropes 52 which are reeved over a traction sheave 54 mounted on the shaft of a suitable traction drive machine 56. Drive machine 56 is controlled by drive control 57. A counterweight 58 is connected to the other ends of the ropes 52.

Car calls, as registered by pushbutton array 60 mounted in the car 12, are recorded, serialized and directed to control 14 as signal 3Z.

Hall calls, as registered by pushbuttons mounted in the hallways, such as the up pushbutton 62 mounted at the bottom floor, the down pushbutton 64 located at the uppermost floor, and the up and down pushbuttons 66 located at the intermediate floors, are recorded and serialized in hall call control 68. The resulting serialized up and down hall calls 1Z and 2Z, respectively, are directed to the control 14.

In general, the averaging strategy of U.S. Pat. Nos. 4,037,688 and 4,046,227 is controlled and operated by a serial, time multiplexed system. Each floor of the building to be serviced is assigned its own time or scan slot in each repetitive time cycle, and thus the number of time slots in a cycle is dictated by the number of floors in the associated building. Each floor has a different timing scan slot associated therewith, but it is not necessary that every scan slot be assigned to a floor level. Scan slots may be generated in cycles of 16, 32, 64 or 128, for example, so the specific cycle is selected such that there will be at least as many scan slots available as there are floor levels.

Each scan slot assigned to a floor, except the terminal floors, has up and down service directions. Thus, there are as many up and down scan slots as there are up and down hall call pushbutton stations in the building, and when it is said that up and down scan slots are assigned to the elevator cars, it means that the assigned elevator car will be able to "see" and immediately respond to calls from the associated up and down hall call pushbuttons.

The assignment of scan slots is built into a predetermined priority structure which includes:

1. the clearing of certain scan slot assignments before each new assignment;

2. the assignment of scan slots in a general order based upon the floors served by the same combination of cars, with each such group being called a "set";

3. the assigment of the scan slots of the sets in a plurailty of assignment passes, changing the limitations applied and the controlling dynamic averages on each pass, with the limitations and dynamic averages including those which are set oriented, as well as building oriented;

4. The assignment of scan slots to the cars enabled for each set according to a dynamic car priority order, calculated prior to each assignment process on the basis of actual work load, as well as considering such factors as whether or not the car has the NEXT assigment, and if a motor-generator set associated with a car is shut down due to a predetemined period of inactivity;

5. the assignment of scan slots to the cars, starting from each car in a predetermined direction, with the predetermined direction for a busy car being its travel direction and with the predetermined direction for an available car being based upon the currently existing traffic conditions and the assignment directions for the busy cars;

6. the assignment of scan slots to busy cars with the limitation that the associated floors are within a predetermined travel distance from the car, as opposed to physical separation; and 7. assigning scan slots to in-service idle cars without the travel distance limitation of (6).

Figure 2:
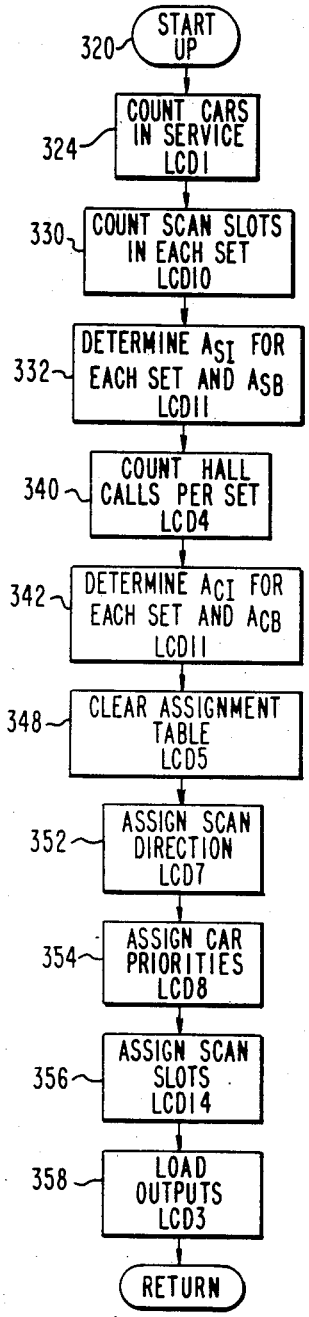
FIG. 2 is a block diagram of the averaging strategy described in the detail in U.S. Pat. No. 4,037,688.

FIG. 2 is a condensation of FIG. 9 of incorporated U.S. Pat. No. 4,037,688, setting forth some of the strategy factors which will be referred to when describing the present invention. The LCD numbers in FIG. 2 refer to detailed flow charts shown and described in the incorporated patents, for performing the specified functions.

More specifically, start-up of the elevator system 10 shown in FIG. 1 is indicated at terminal 320. Step 324 counts the number of elevator cars which are in-service with the system control 14 ($N_{SC}$).

Step 330 counts the scan slots in each set as well as the total number of scan slots in the building and stores these sums for future reference. Each hall call pushbutton is assigned a scan slot. Thus, in a building with 16 levels, the first and sixteenth levels would have 1 scan slot, and the intervening 14 floors or levels would each have 2 scan slots, making a total of 30 scan slots. A set refers to a group of floors served by the same combination of cars. With four cars, for example, there may be as many as 16 different sets, with the set 0000 being an invalid set. If all cars serve all floors, there would only be 1 valid set.

Step 322 determines the average number of scan slots per set, $A_{SI}$, by dividing the scan slots in each set, determined in step 330, by the number of in-service cars capable of serving the set ($N_{SCI}$). Step 332 also determines $A_{SB}$, the average number of scan slots in the building per in-service elevator car, by dividing the total number of scan slots in the building by $N_{SC}$, the number of cars in-service.

Step 340 counts the number of hall calls per set, as well as the total number of hall calls in the building, and stores these sums for future reference.

Step 342 determines the average number of registered hall calls per set, $A_{CI}$, by dividing the number of hall calls in each set by the number of in-service cars serving the set. The average number of registered hall calls per car in the building, $A_{CB}$, is determined by dividing the total number of hall calls in the building by $N_{SC}$, the number of in-service elevator cars.

Step 348 clears the up and down assignment tables, stored in RAMS 6 and 7, respectively, of all scan slot assignments except: (2) previously assigned scan slots which have a registered hall call associated therewith, and (b) scanslots from a one car set.

Step 352 assigns the direction from an in-service idle car in which the assignment of scan slots are to be made to the car. If a car is busy, the scan direction for assigning scan slots to the car is the car's travel direction.

Step 354 assigns the order in which the cars are to be considered when assigning scan slots to them, with the car having the fewest combined car and hall calls being considered first, etc.

Step 356 assigns the scan slots of each set to the cars, in the car order determined by step 354. The sets are considered in the order of increasing number of cars per set.

The assignments of the scan slots to the cars associated wih each set are made in a plurality of passes, such as three. The first assignment pass is a specific assignment pass which takes car of pre-identified situations priorities. The second pass is a general assignment which assigns scan slots to the cars of the sets subject to predetermined dynamic limiting averages and a distance limitation. A third pass may be used to try to assign any unassigned scan slots, which may remain after the first two passes. The third pass removes certain limitations used during the second passs.

Step 358 outputs the assignments to the elevator cars and then returns to repeat and update the previously described program functions.

Figure 3:
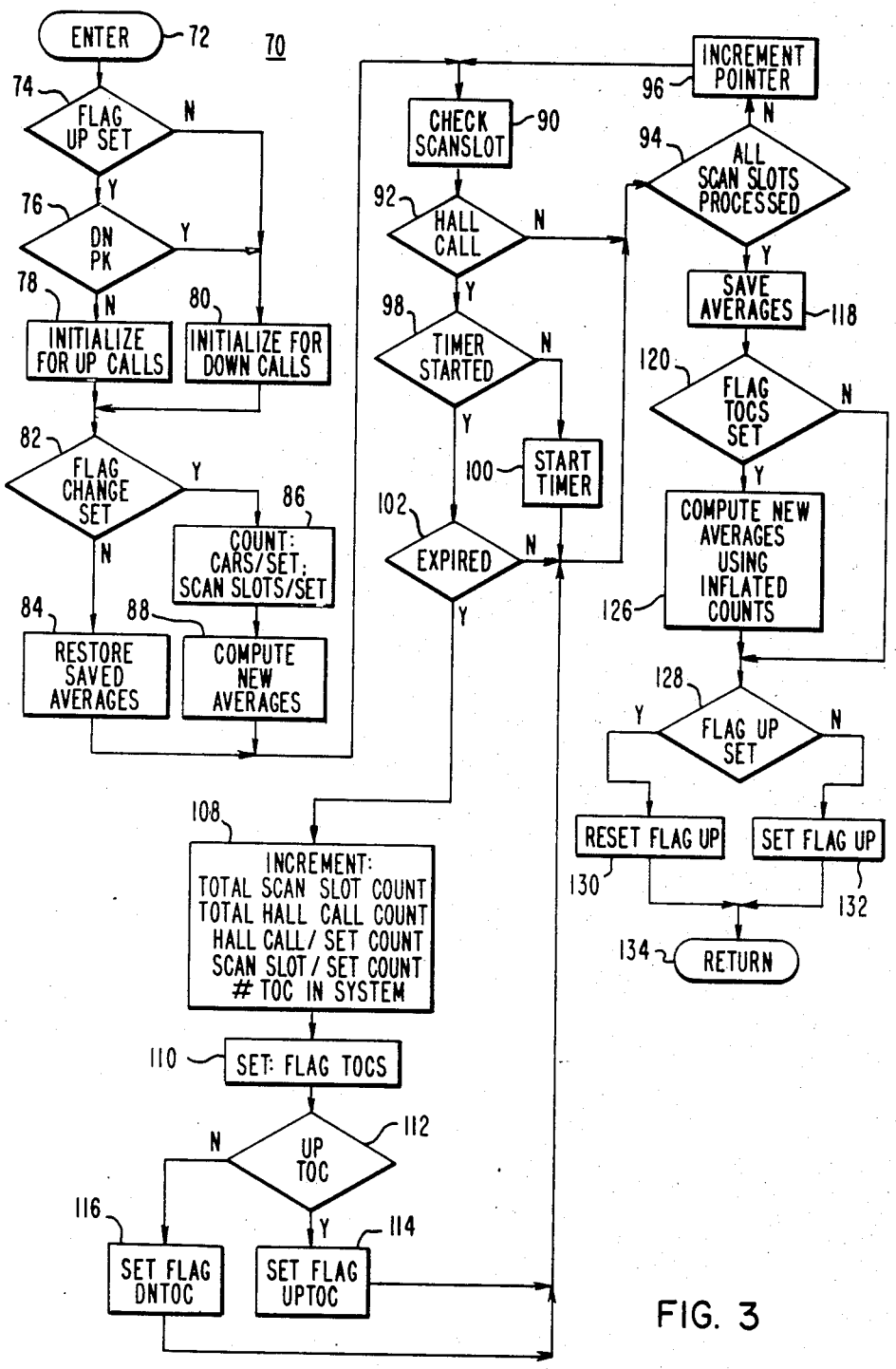
FIG. 3 is a detailed flow chart of a program which processes the hall calls, and places timed-out call strategy in bid when a hall call is registered for a predetermined period of time.

FIG. 3 is a detailed flow chart of a program 70 which may be used by the supervisory strategy portion of control 14 to perform part of the timed-out call strategy according to the teachings of the invention. The RAM maps of FIGS. 4 and 5 will be referred to when appropriate during the following description of prorgram 70.

More specifically, program 70 is entered at 72 and step 74 checks to see if a flag Up is set. Flag UP is shown in the RAM map of FIG. 5. It is used to determine whether up or down hall calls should be processed during this run through the program. If flag UP is set, it indicates that up calls should be processed during this run.

The timed-out call strategy of the present invention may, or may not, take into consideration the existence of certain peak traffic conditions in the building. For example, if the building is experiencing a down traffic peak condition, it may be desirable to process only down timed-out hall calls while the peak exists. The incorporated U.S. Pat. No. 4,037,688 includes a program for detecting certain types of peak traffic conditions.

Figure 4:
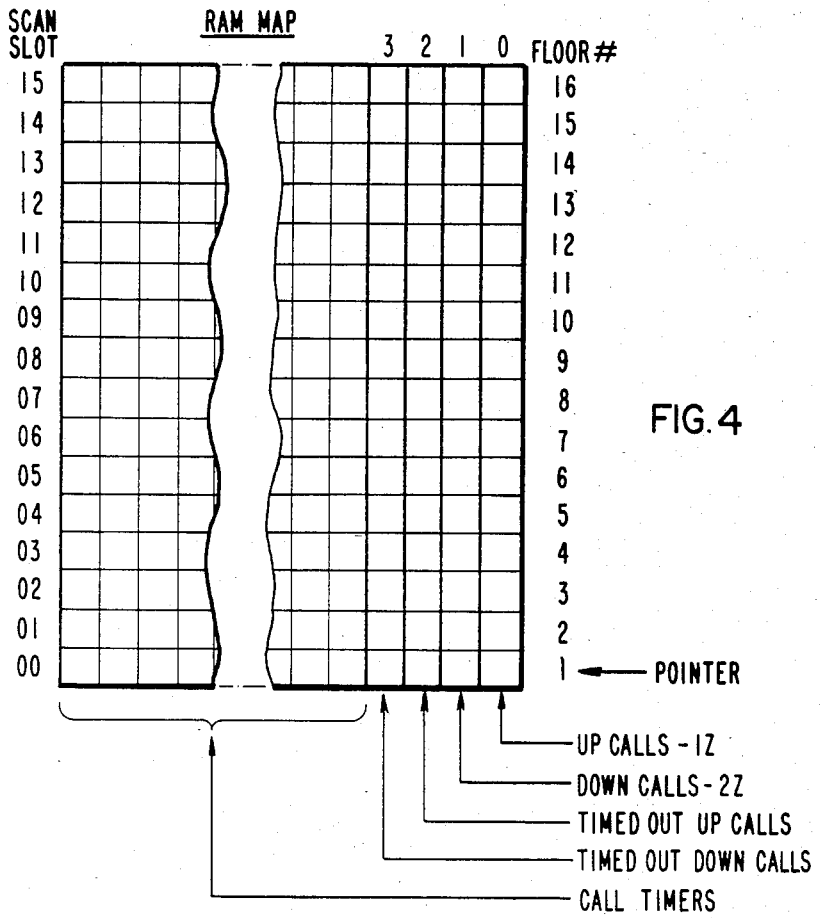
FIG. 4 is a RAM map illustrating a format which may be used to store hall calls, to time hall calls, and to indicate timed-out hall calls.

Thus, even though flag UP is found to be set in 74, step 74 may proceed to step 76 which checks to see if the system is in a down peak traffic condition, such as by checking signal DNPK. If step 76 finds that the elevator system is not in a down traffic peak condition, step 76 may proceed to step 78 which initializes the program for considering up calls. For example, in the RAM map shown in FIG. 4, a pointer may be initialized to scan slot 00 of a building related table, indicating the first or lowest floor, and, in the example shown, bit position 0 would be examined in each scan slot for the presence of an up call. As illustrated in FIG. 4, when the serial signals representing the up and down hall calls, referred to as 1Z and 2Z, respectively, are read by the system, they are stored in the first two bit positions of each scan slot.

If step 74 finds that flag UP is not set, it indicates that down hall calls should be processed during this run through program 70. Even when flag UP is set, if step 76 finds that the DNPK bit is set, indicating a system down peak, only down timed out hall calls will be processed. In these situations, the "no" and "yes" branches of steps 74 and 76 proceed to step 80, which initializes the system for examining down hall calls, which appear at bit position 1 in the RAM map of FIG. 4.

Steps 78 and 80 proceed to step 82, which checks a flag CHANGE to see if there has been a change in the elevator system which would necessitate the calculation of new averages. Such a change, for example, may be an elevator car going into or out of service, or a hall call being registered or cancelled. If step 82 finds that the flag CHANGE is not set, step 84 restores the previously calculated and saved averages. If step 82 finds that the flag CHANGE has been set, the program branches to step 86 which counts the number of cars per set, and the number of scan slots per set. Step 88 then computes new averages.

Steps 84 and 88 both proceed to step 90, which checks the scan slot being considered for the presence of a hall call. Step 92 checks the results of step 90, and if no hall call is found in the scan slot, step 92 proceeds to step 94 which checks to see if all of the scan slots have been processed. If they have not, step 94 proceeds to step 96 which increments the pointer shown in FIG. 4, and step 90 checks the new scan slot.

When step 92 finds a hall call in the bit of the scan slot being examined, step 98 checks to see if a timer associated with this hall call has been activated. As shown in the RAM map of FIG. 4, the timer may be a software timer. The software timers may be tended to by a timer interrupt program, not shown. If step 98 finds that the timer has not been activated, step 100 starts the timer and returns to step 94. If step 98 finds that the timer has been activated, step 102 checks to see if the timing interval of the activated timer has expired. If the predetermined time selected to signify a timed-out hall call has not expired, step 102 returns to step 94. If step 102 finds that the activated timer has expired, step 102 proceeds to step 108.

Step 108 increments: (a) the total scan slot count for the building, (b) the total hall call count for the building, (c) the hall call per set count, and (d) the scan slot per set count. Step 108 also increments the count representing the number of timed-out calls in the system. These averages and counts are illustrated in the RAM map of FIG. 5. Thus, step 108 artificially inflates the total number of hall calls in the building by 1, since this hall call has already been counted, and it also inflates the scan slot count by 1. Inflating these counts more accurately reflects each car's work load, and it prevents the two cars now assigned to a timed-out call from being unduly loaded in subsequent assignments of scan slots.

Figure 5:
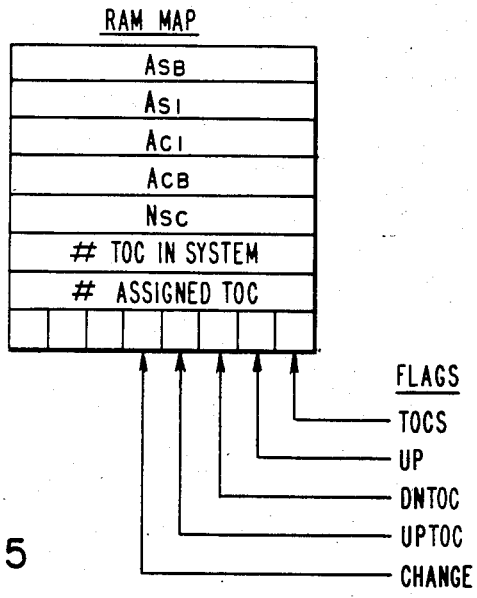
FIG. 5 is a RAM map illustrating program variables and flags used in the programs of FIGS. 2 and 5.

Step 108 proceeds to step 110 which sets the system timed-out call flag TOCS, shown in FIG. 5, which indicates that there is a timed-out call in the system. Step 112 checks to see if the timed-out call is an up hall call. If it is, step 114 sets the flag UPTOC. If it is not an up hall call, step 116 sets a flag DNTOC. Flags DNTOC and UPTOC are shown in the RAM map of FIG. 5. Flag UPTOC is set when there is an up direction timed-out call in the system, which has not had an additional car assigned to it. In like manner, flag DNTOC is set when there is a down direction timed-out hall call which has not yet had an additional car assigned to it. Steps 114 and 116 both proceed to step 94.

When all of the can slots are found to have been processed by step 94, step 94 proceeds to step 118 which saves the previously computed averages. Step 118 then proceeds to step 120 which checks to see if flag TOCS has been set. If it has been set, it indicates there is a timed-out call in the SYSTEM and the number of scan slots and the number of hall calls has been increased. Step 126 then computes new averages using the inflated counts. If step 120 finds that flag TOC has not been set, step 120 proceeds to step 128, as does step 126.

Step 128 checks to see if the flag UP has been set. If flag UP is not set, it indicate that up hall calls have just been processed, and step 130 resets flag UP. If step 128 finds that flag UP is not set, it indicates that down hall calls have just been processed, and step 32 sets flag UP. The program then returns to the priority executive at step 134.

FIG. 6 is a detailed flow chart of a program 139 which may be run when there is a timed-out call in the system. For example, the program of 70 of FIG. 3 may place program 139 in bid when it finds a timed-out call. Program 139 is entered at 140 and step 142 checks to see if the number of assigned timed-out calls is equal to the maximum allowed by the strategy. In a preferred embodiment, the number of timed-out calls which may be assigned to an elevator car is limited to 1. If elevator system 10 is an eight car system, for example, then the maximum number of assigned timed-out calls is eight. If step 142 should find that the maximum number of assigned timed-out calls already exists, program 139 exits at 144.

If the number of assigned timed-out calls is less than the maximum, step 146 checks to see if flag DNTOC is set. If it is not set, it indicates that there are no timed-out down calls which have not had an additional car assigned to them. If flag DNTOC is not set, step 148 checks to see if flag UPTOC is set. If flag UPTOC is not set, there are no up direction timed-out calls which do not have two elevator cars assigned to them, and the program returns at 150.

If step 146 finds that flag DNTOC is set, step 152 initializes the pointer shown in the RAM map of Figure 4 for down timed-out calls, which appear in bit position three of each scan slot. When step 148 finds flag UPTOC set, step 156 initializes the pointer shown in FIG. 4 for up direction timed-out calls.

STEPS 152 and 156 each proceed to step 160 which checks the scan slot at the position of the pointer, and step 162 determines if the checked scan slot indicates that there is a timed-out call. If step 162 finds no timed-out call, step 194 increments the scan slot pointer, and step 196 checks to see if all of the scan slots have been processed. If they have not, step 196 returns to step 160.

When step 162 finds a timed-out call, step 164 checks to see if there is already more than one car assigned to this scan slot. If there is, it indicates that this timed-out call has already been processed, and the program advances to step 194. If step 164 finds that there is not more than one car assigned to this scan slot, step 166 initializes the car loop, starting with the least busy car. The elevator cars are ordered in block 354 of FIG. 2, with the least busy car at at the head of the order.

Step 168 checks to see if the first car of the ordered cars is enabled to serve the floor associated with the timed-out call. If the car being checked is not enabled to serve this floor, step 168 proceeds to step 170 which increments the car loop. Step 172 then checks to see if all of the cars have been checked. If they have not all been checked, step 172 returns to step 168.

When step 168 finds an elevator car which is enabled to serve the floor of the timed-out call, step 174 determines if this elevator car has already been assigned to a timed out call. As hereinbefore stated, the preferred embodiment only assigns one timed out call to an elevator car, and when step 174 finds that the car already has such an assignment, step 174 returns to step 170 to inrement the car loop. If step 174 finds that the car does not already have a timed-out call assignment, step 176 stores the identification number of the car. Step 176 proceeds to step 178, as does step 172 when step 172 finds that all of the cars of the car loop have been checked. Step 178 determines if an elevator car has been found for the timed-out call. When no car has been found, step 178 proceeds to step 194 to increment the scan slot pointer. When step 178 finds that an elevator car has been found for the timed-out call, step 180 checks to see if the timed-out call in question is an up call. If it is, step 182 resets the flag UPTOC and the program proceeds to step 186. When step 180 finds that the timed-out call is not an up direction call, step 180 proceeds to step 184 which resets flag DNTOC. Step 184 also proceeds to step 186.

Step 186 increments the number of assigned timed-out calls in the system, which is shown in the RAM map of FIG. 5. Step 188 then assigns the scan slot associated with the timed-out call to the elevator car which was found for the call.

It the number of assigned timed-out calls is now equal to the maximum, there is no need to continue. Thus, this count is checked in step 190. If the number if found to equal to the maximum number of allowed timed-out calls, the program returns to the priority executive at 192. If step 190 finds that the number of assigned timed-out calls is not equal to the maximum number, step 190 proceeds to step 194 which increments the scan slot pointer to check the next scan slot.

Figure 7:
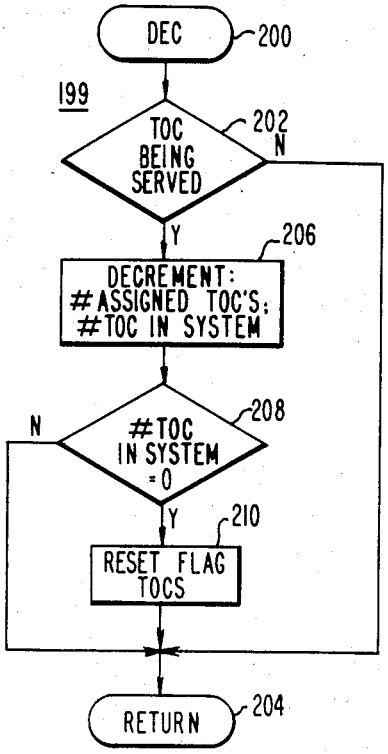
FIG. 7 is a detailed flow chart illustrating steps which may be taken when a timed-out call has been served.

FIG. 7 is flow chart of a program 199, which may be part of a program called or placed into bid when an elevator car initiates deceleration to serve a hall call. When an elevator car starts to decelerate to serve a floor, a signal DEC goes true, which may trigger the running of program 199. Program 199 is entered at 200 and step 202 checks to see if a timed-out call is being served. If it is not, the program returns to the priority executive, or to other steps of the deceleration program 199, at point 204.

When step 202 finds that a timed-out call is being served, step 206 decrements the number of assigned timed-out calls, and it decrements the number of timed-out calls in the system. Step 208 then checks to see if the number of timed-out calls in the system is equal to 0. If it is not, the program returns to 204. If the number of timed-out calls in the system is now equal to 0, step 210 resets flag TOCS.

Figure 8:
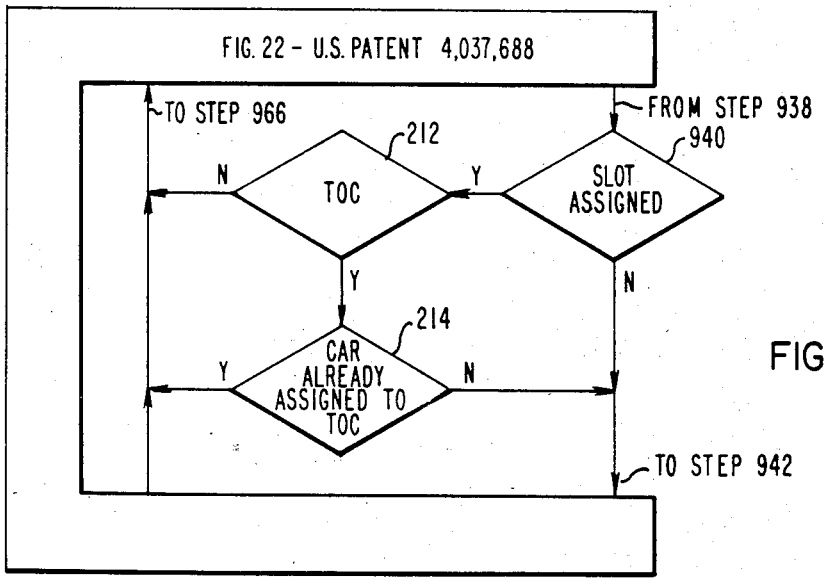
FIG. 8 illustrates how the strategy of U.S. Pat. No. 4,037,688 may be modified according to the teachings of the invention.

Up to this point, the implementation of the timed-out call feature shown in FIG. 6 assumes the calling of a separate program module. The strategy of FIG. 6, however, may be easily implemented into the scan slot assignment process of incorporated U.S. Pat. No. 4,037,688. For example, as shown in FIG. 8, which is a modification of a portion of FIG. 22 of U.S. Pat. No. 4,037,688, only three decision blocks need be added to the assignment process. The program steps in FIG. 8 which are the same as those in the incorporated patent retain the same 900 series reference numerals from the patent.

More specifically, step 938 of FIG. 22 of U.S. Pat. No. 4,037,688 proceeds to step 940 which checks to see if the scan slot being checked has already been assigned to an elevator car. In the strategy of the incorporated patent, each scan slot can be assigned to only one elevator car. If step 940 finds that the scan slot has already been assigned, instead of proceeding immediately to step 966, a new step 212 is added which checks to see if there is a timed-out call associated with the scan slot. If there isn't, then the program advances to step 966. When step 212 finds that there is a timed-out call associated with the scan slot being considered, step 212 proceeds to a new step 214 which checks to see if the car under consideration has already been assigned to a timed-out call. If it has, step 214 proceeds to step 966. If the car under consideration has not already been assigned to a timed-out call, step 214 proceeds to step 942, as does the no branch from step 940.

In summary, there has been disclosed a new and improved elevator system of the averaging type which assigns hall call pushbuttons to all of the elevator cars based upon dynamic system averages, with the system including strategy for giving preferential treatment to a floor, or floors, having timed-out hall calls. The improved strategy works within the averaging concepts of the incorporated U.S. patents, assigning two elevator cars to the floor and service direction of a timed-out call, and inflating the number of scan slots and the number of hall calls by one, in order to reflect the double assignment. The assignment of an additional car to a timed-out call is made to the car having the lightest work load, of all of the cars capable of serving that call.

We claim as our invention:

1. A method of providing special service for a hall call registered for a predetermined period of time in an elevator system having a plurality of elevator cars mounted in a building to serve the floors therein, comprising the steps of:

providing an actual call per car average responsive to the number of registered hall calls and the number of cars enabled to serve them, providing a prospective call per car average responsive to the number of possible hall calls and the number of cars enabled to serve them, assigning the floors and service directions therefrom to the elevator cars responsive to said actual and prospective hall call per averages, timing the duration of at least certain of the hall calls, indicating that a hall call has timed-out when it has been registered for a predetermined period of time, selecting an elevator car from all of the elevator cars suitably conditioned to serve a timed-out call responsive to their relative work loads.

and assigning the floor and service direction associated with a timed-out call to the car selected in the selecting step, while maintaining the prior assignment of the same floor and service direction previously made to another elevator car.

2. The method of claim 1 wherein the step of selecting an elevator car to serve a timed-out call includes the step of disregarding an elevator car for a timed-out call assignment which has already been assigned to a floor and service direction having a timed-out call.

3. The method of claim 1 wherein the step of selecting an elevator car to serve a timed-out call includes the step of ordering the elevator cars according to their relative work schedules, and considering the cars in the order resulting from said ordering step.

4. The method of claim 1 wherein the assignment of a timed-out call to a car includes the steps of adding an additional count to the number of actual calls, and adding an additional count to the number of prospective calls.

5. An elevator system for a building having a plurality of floors, comprising:

a plurality of elevator cars, means mounting said plurality of elevator cars in said building for movement relative to the floors, up and down hall call registering means for registering calls for elevator service in the up and down service directions, respectively, from at least certain of the floors, averaging means for providng a first average responsive to the number of registered up and down hall calls in the building and the number of in-service elevator cars, and a second average responsive to the number of up and down hall call registering means in the buidling and the number of in-service elevator cars, control means for effectively dividing the hall call registering means among the in-service elevator cars, and for assigning the associated floors and service directions therefrom to all of the in-service elevator cars, in response to both said first and second averages, timing means for timing at least certain of the hall calls, and means for indicating that a hall call has timed out after being registered for a predetermined period of time, said control means additionally assigning the floor and service direction associated with a timed-out call to an elevator car having the lightest work load, of all of the elevator cars capable of serving the timed-out call, said control means maintaining any prior assignment of the same floor and service direction made to another elevator car before the hall call timed out.

6. The elevator system of claim 5 wherein the control means includes means for determining if an elevator car has already been assigned to a floor and service direction associated with a timed out call, assigning a floor and service direction associated with a timed-out call only to a car not already assigned to a timed-out call.

7. The elevator system of claim 5 wherein the control means includes ordering means for ordering the elevator cars according to their relative work schedules, considering the elevator cars for possible assignment to the floor and service direction associated with a timed-out call in the order provided by said ordering means.

8. The elevator system of claim 5 wherein the control means includes means for effectively adding an additional hall call and an additional hall call registering means to their respective numbers used by the averaging means in providing the first and second averages, in response to the assignment of an additional car to the floor and service direction associated with a timed-out call.

* * * * *